US012674579B2

(12) United States Patent
Weber et al.

(10) Patent No.: US 12,674,579 B2
(45) Date of Patent: Jul. 7, 2026

(54) COMBUSTOR LINER V-BAND WITH DIRECTED AIR FLOW

(71) Applicant: PRATT & WHITNEY CANADA CORP., Longueuil (CA)

(72) Inventors: Jacob Weber, Toronto (CA); Safouane Tebib, Etobicoke (CA); Mohammad Mortada Ahmed, Kitchener (CA); Jeffrey Verhiel, Mono (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 18/906,880

(22) Filed: Oct. 4, 2024

(65) Prior Publication Data

US 2026/0098638 A1 Apr. 9, 2026

(51) Int. Cl.
*F23R 3/00* (2006.01)
*F23R 3/06* (2006.01)

(52) U.S. Cl.
CPC ..... *F23R 3/002* (2013.01); *F23R 3/06* (2013.01); *F23R 2900/03045* (2013.01)

(58) Field of Classification Search
CPC ..... F23R 3/002; F23R 3/06
See application file for complete search history.

(56) References Cited

U.S. PATENT DOCUMENTS 2,657,531 A 11/1953 Pierce
5,303,543 A 4/1994 Shah et al.
6,155,056 A 12/2000 Sampath et al.
6,408,629 B1 6/2002 Harris et al.
6,427,446 B1 8/2002 Kraft et al.
6,711,900 B1 3/2004 Patel et al.
7,441,409 B2 10/2008 Patel et al.
7,954,326 B2 6/2011 Lai et al.
10,634,350 B2 4/2020 Harding et al.
11,204,169 B2 12/2021 Sze
2004/0159106 A1* 8/2004 Patel ..... F23R 3/60 60/755

(Continued)

FOREIGN PATENT DOCUMENTS

EP 2759772 A1 7/2014
FR 2947035 B1 7/2011

(Continued)

OTHER PUBLICATIONS

Extended European Search Report for EP Application No. 25207022.2-1002, dated Feb. 20, 2026, 8 pages.

*Primary Examiner* — Katheryn A Malatek
(74) *Attorney, Agent, or Firm* — Kinney & Lange, P.A.

(57) ABSTRACT

A combustion liner v-band includes a louver segment having an arcuate member, an array of scoops, and outlet openings. The arcuate member includes an interior wall and side walls extending partially circumferentially about a centerline axis of the combustor to bound a channel that is open at a radial outer boundary of the arcuate member. The scoops extend from the interior wall. The outlet openings extend through the interior wall and the scoops to place the channel in fluid communication with a region exterior to the louver segment. Each outlet opening extends along a discharge axis that has a nonzero axial angle component and a nonzero circumferential angle component.

17 Claims, 7 Drawing Sheets

(56) References Cited

U.S. PATENT DOCUMENTS

| | | | | |
|---|---|---|---|---|
| 2007/0227149 | A1* | 10/2007 | Biebel | F23R 3/06 60/752 |
| 2007/0234726 | A1 | 10/2007 | Patel et al. | |
| 2017/0130651 | A1* | 5/2017 | Nasr | F23R 3/06 |
| 2019/0017440 | A1* | 1/2019 | Porter | F23R 3/06 |
| 2020/0166211 | A1* | 5/2020 | Dudebout | F23R 3/06 |
| 2023/0194087 | A1 | 6/2023 | Singh et al. | |

FOREIGN PATENT DOCUMENTS

| | | | |
|---|---|---|---|
| FR | 2944584 | B1 | 8/2014 |
| FR | 2920221 | B1 | 4/2015 |
| GB | 2073396 | A | 10/1981 |
| JP | S581332 | B2 | 1/1983 |

* cited by examiner

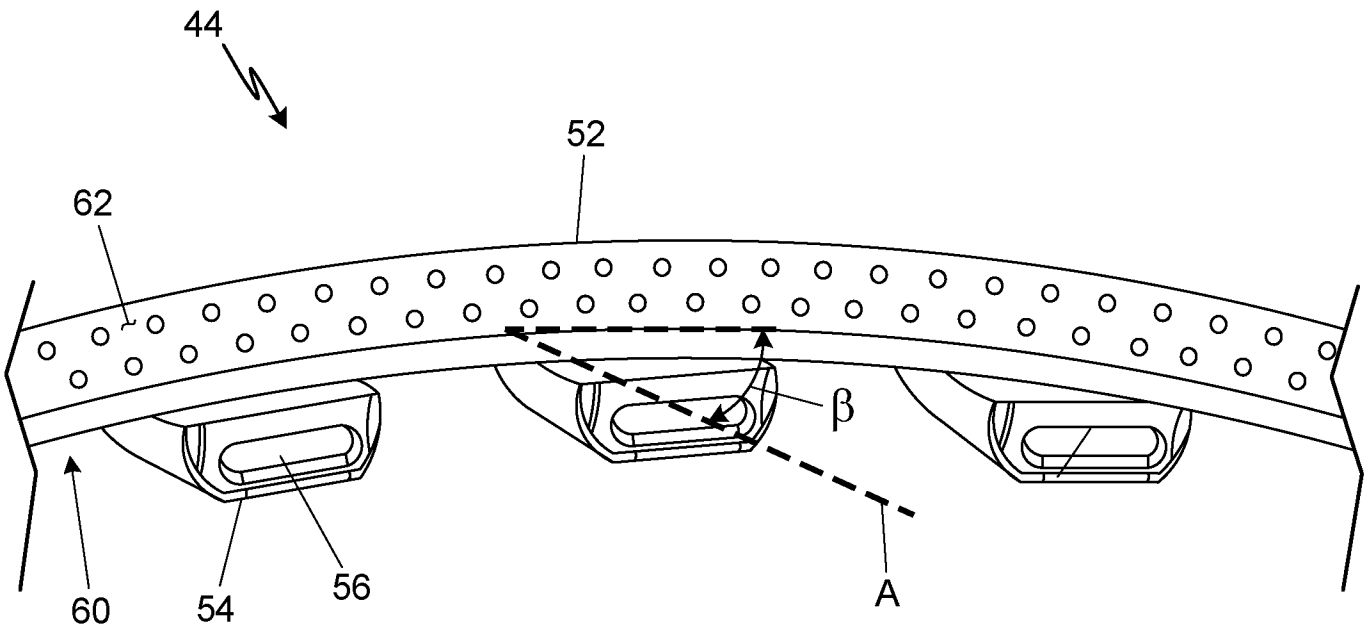
Fig. 7
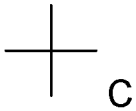

COMBUSTOR LINER V-BAND WITH DIRECTED AIR FLOW

BACKGROUND

The invention relates to combustor liners, and more specifically to combustor v-band louvers that provide cooling as well as promote beneficial flow characteristics within the combustor.

Gas turbine engine combustors utilize cooling holes to thermally protect liner walls from the heat of combustion. In some instances, v-band louvers are used to direct cooling air along the liner wall in the upstream direction and the downstream direction relative to a flow through the combustor. Circumferentially directed passages exiting along the interior wall of the v-band louver cool the v-band louver, which generates a toroidal flow proximate the interior wall. While v-bands with circumferentially oriented interior outlet openings are considered suitable for their intended purpose, improved cooling of the interior v-band surfaces and adjacent liner surfaces is highly desirable.

SUMMARY

A louver segment and combustor assembly equipped with one or more louver segments includes an arcuate member, a plurality of scoops, and a plurality of first outlet openings. The arcuate member includes an interior wall and side walls extending partially circumferentially about a centerline axis to bound a channel that is open at a radial outer boundary of the arcuate member. The side walls converge towards the interior wall. The plurality of scoops extends from the interior wall. The plurality of first outlet openings extends through the interior wall and the scoops to place the channel in fluid communication with a region exterior to the louver segment. Each first outlet opening includes a discharge axis extending through a geometric center of a cross-sectional area of each outlet opening. Each discharge axis has a nonzero axial angle component and a nonzero circumferential angle component.

BRIEF DESCRIPTION OF THE DRAWINGS

FIG. 7 is an end view depicting the louver segment axial end view.

DETAILED DESCRIPTION

Figure 1:
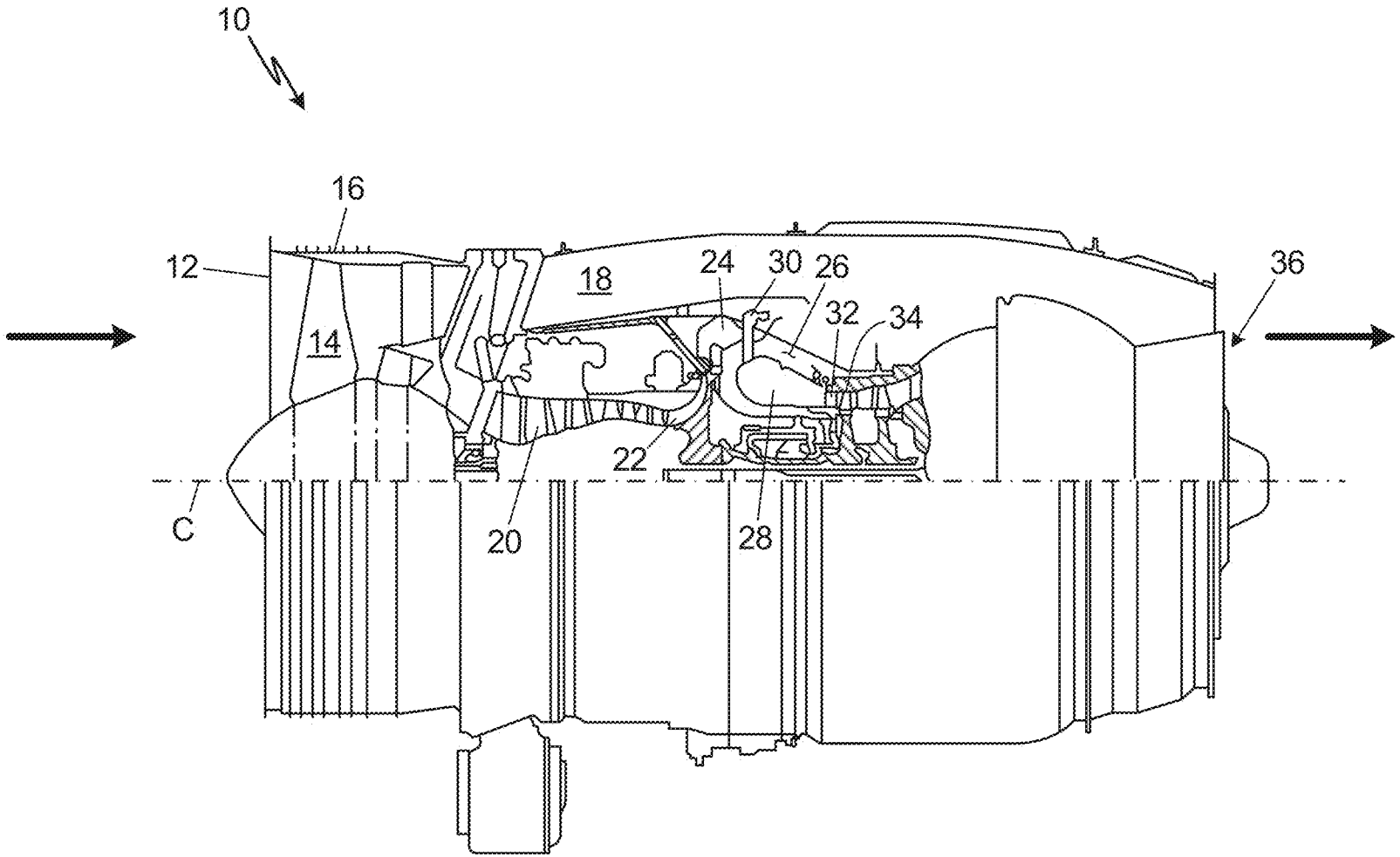
FIG. 1 is an axial cross-section through an example gas turbine engine.

FIG. 1 is an axial cross-section through an example gas turbine engine 10 that can be equipped with a combustor with a v-band liner in which the v-band liner is formed by one or more louver segments described herein. While gas turbine engine 10 is depicted as a turbofan engine, one or more louver segments can be incorporated into combustors of other types of gas turbine engines. In some examples, gas turbine engine 10 can be a turboshaft engine or a turboprop engine suitable for propulsion of an aircraft and/or providing power to an auxiliary system of the aircraft (e.g., an auxiliary power unit). In other examples, gas turbine engine 10 can be a ground-based industrial gas turbine engine or an aeroderivative gas turbine engine. Further, gas turbine engine 10 can include fewer or more compressor stages and/or turbine stages than the number of stages depicted by FIG. 1 and said stages can be configured as axial compressors and/or turbines, or centrifugal compressors and/or turbines arranged to form fewer or more shaft spools than the configuration depicted in FIG. 1.

As depicted in FIG. 1, gas turbine engine 10 includes inlet 12, fan 14, fan case 16, bypass duct 18, low-pressure axial compressor 20, high-pressure centrifugal compressor 22, diffuser 24, plenum 26, combustor 28, fuel tubes 30, nozzle guide vane 32, turbines 34, and exhaust nozzle 36. Air intake into gas turbine engine 10 through inlet 12 passes over fan 14 in fan case 16 and is then split into an outer annular flow through the bypass duct 18 and an inner flow through the low-pressure axial compressor 20 and high-pressure centrifugal compressor 22. Compressed air exits high-pressure centrifugal compressor 22 through diffuser 24 and is contained within plenum 26 that surrounds combustor 28. Fuel supplied to combustor 28 through fuel tubes 30 mixes with air supplied from plenum 26 when sprayed through nozzles into combustor 28 as a fuel air mixture and is ignited. A portion of the compressed air within plenum 26 is admitted into combustor 28 through orifices in the side walls to create a cooling air film along the combustor walls or is used for cooling, which eventually mixes with the hot gases from combustor 28 and passes over nozzle guide vane 32 and turbines 34 before exiting nozzle 36 as exhaust. It will be understood that the foregoing description is intended to be exemplary of only one of many possible configurations of engine suitable for incorporation of the present invention.

Figure 2:
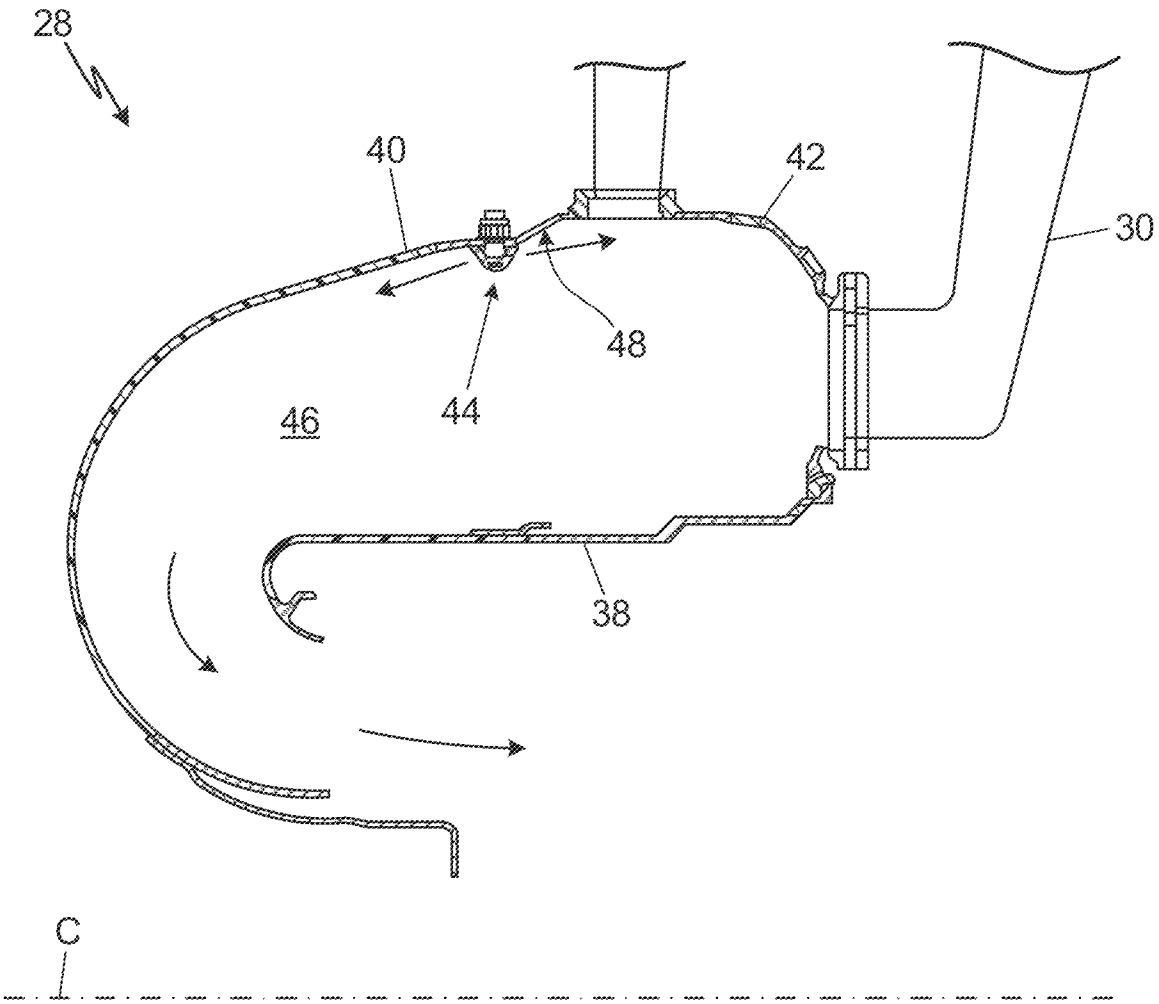
FIG. 2 is an axial cross-section through a combustor of the example gas turbine engine.

FIG. 2 is an axial cross-section of combustor 28 with inner wall 38, outer wall 40, head wall 42 (collectively liner walls), and louver segment 44. Inner wall 38 is spaced radially inward from outer wall 40 relative to centerline axis C to form annular combustion chamber 46. Head wall 42 extends from inner wall 38 to outer wall 40 to enclose an upstream end of combustor 28. Fuel tube 30 communicates with combustion chamber 46 via a port extending through head wall 42, however, the fuel nozzle arrangement is not shown, for simplicity. An ignitor extends through a port of outer wall 40 and is positioned in relation to one or more fuel tubes 30 to initiate combustion within combustion chamber 46. In some examples, outer wall 40 of combustor 28 can include radial step 48 that reduces the radial dimension of outer wall 40 downstream from ignitor port 50 and forms a portion of outer wall 40 that faces upstream towards head wall 42. Radial step 48 can be angled such that the upstream-facing portion of outer wall 40 additionally faces in a radially inward direction.

Louver segment 44 attaches to outer wall 40 and is spaced downstream from ignitor port 50 and head wall 42. Examples of combustor with radial step 48 can include louver segment 44 attached to outer wall 40 downstream of radial step 48. In further examples, louver segment 44 can be axially adjacent to radial step 48 as shown in FIG. 2. Louver segment 44 communicates with openings in outer wall 40 that place louver segment 44 in fluid communication with plenum 26 for distributing air into combustor 28.

Figure 3:
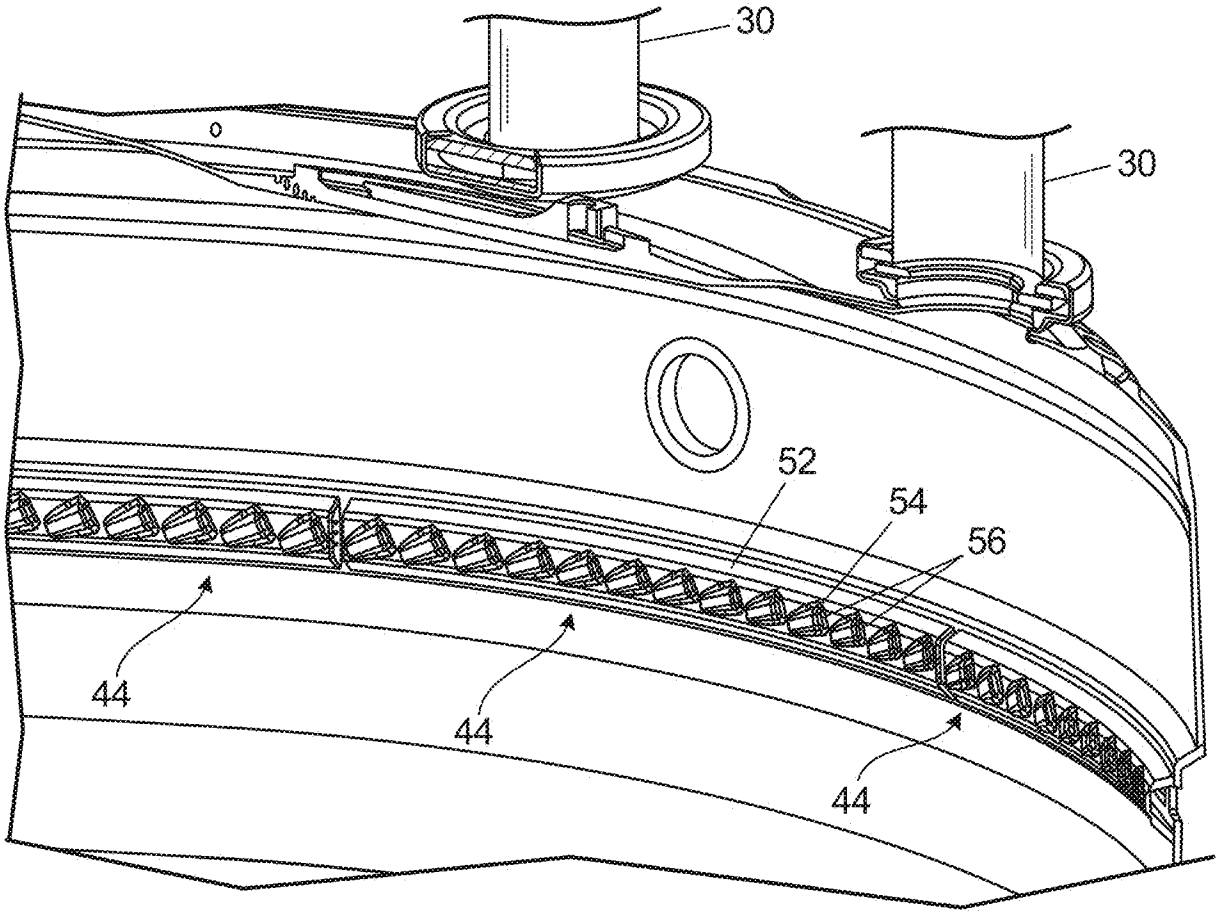
FIG. 3 is a partial isometric view of the combustor depicting multiple louver segments.

FIG. 3 is a partial isometric view of combustor 28 depicting multiple louver segments 44 and an upstream portion of combustion chamber 46 including portions of head wall 42 and outer wall 40. As depicted, multiple louver segments 44 arranged in a circumferential array about an interior surface of outer wall 40. Each louver segment 44 includes arcuate member 52, scoops 54, and outlet openings 56. A first set of outlet openings (i.e., outlet openings 56A) extends through arcuate member 52 and scoops 54 to admit air from plenum 26 into combustion chamber 46 to form a toroidal flow pattern biased axially towards head wall 42 (i.e., in an upstream combustor flow direction).

Figure 4:
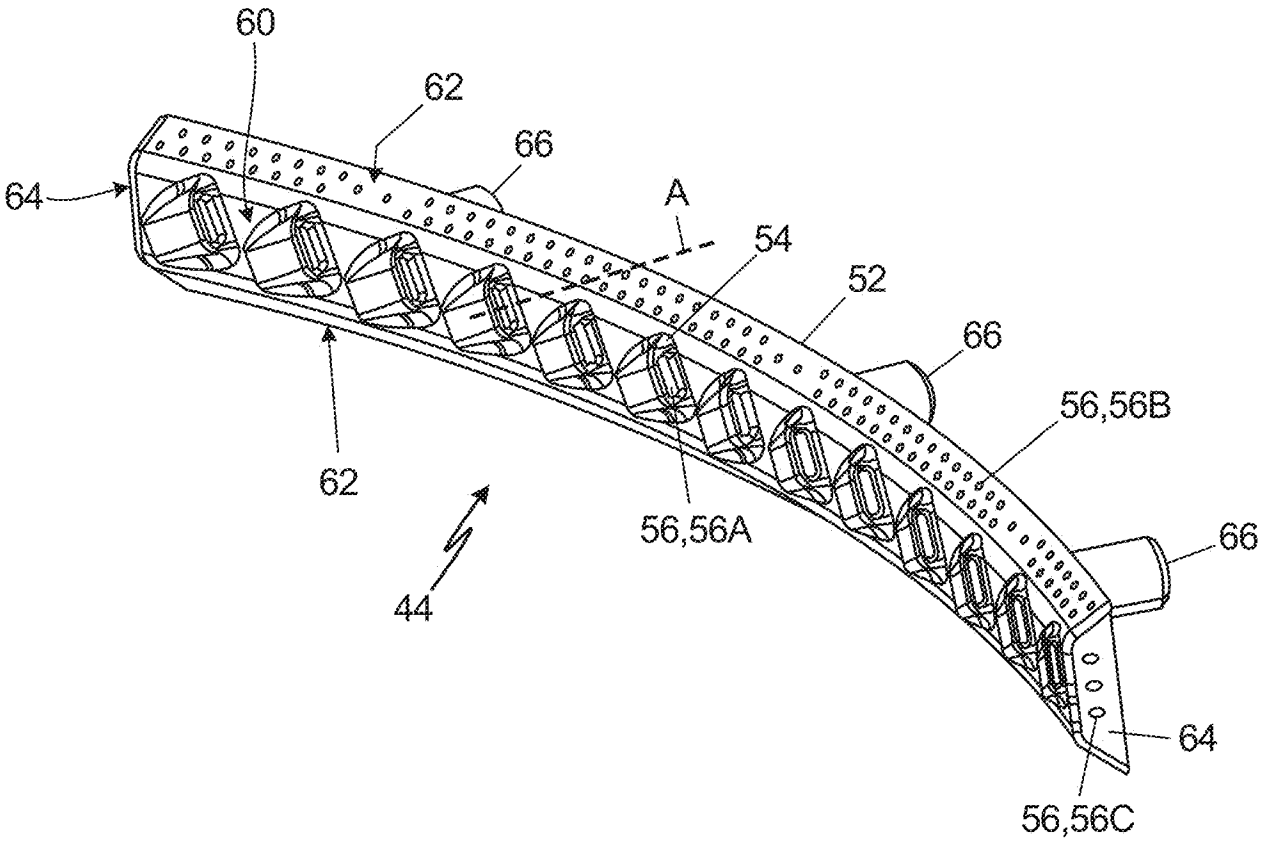
FIG. 4 is an isometric view of a louver segment.
Figure 5:
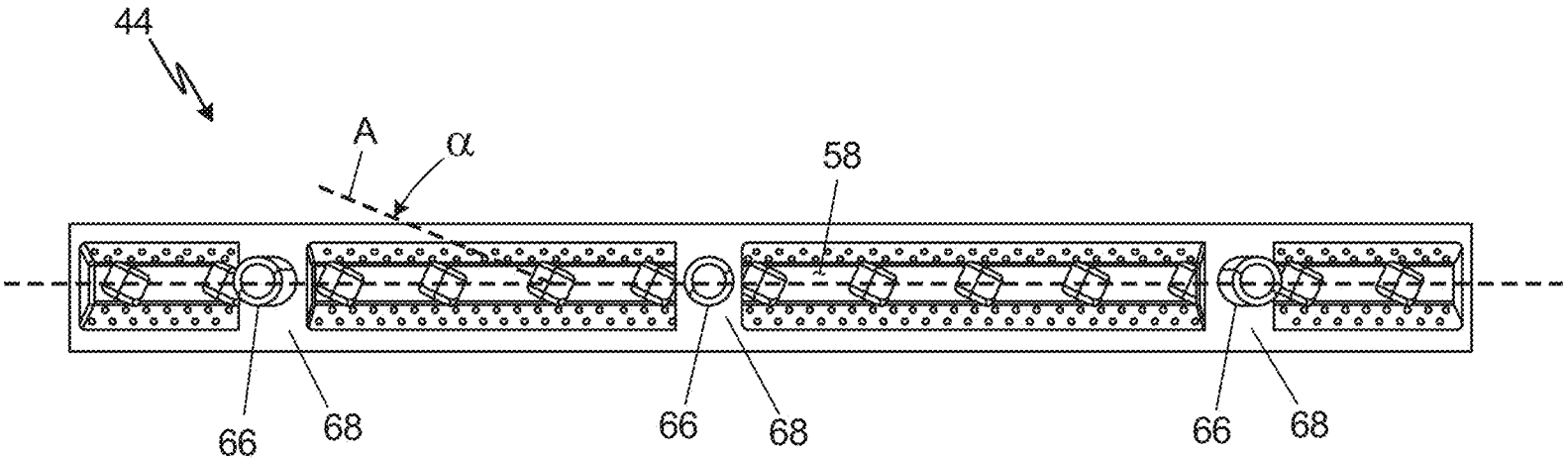
FIG. 5 is a plane view depicting the radial outer boundary of the louver segment.
Figure 6:
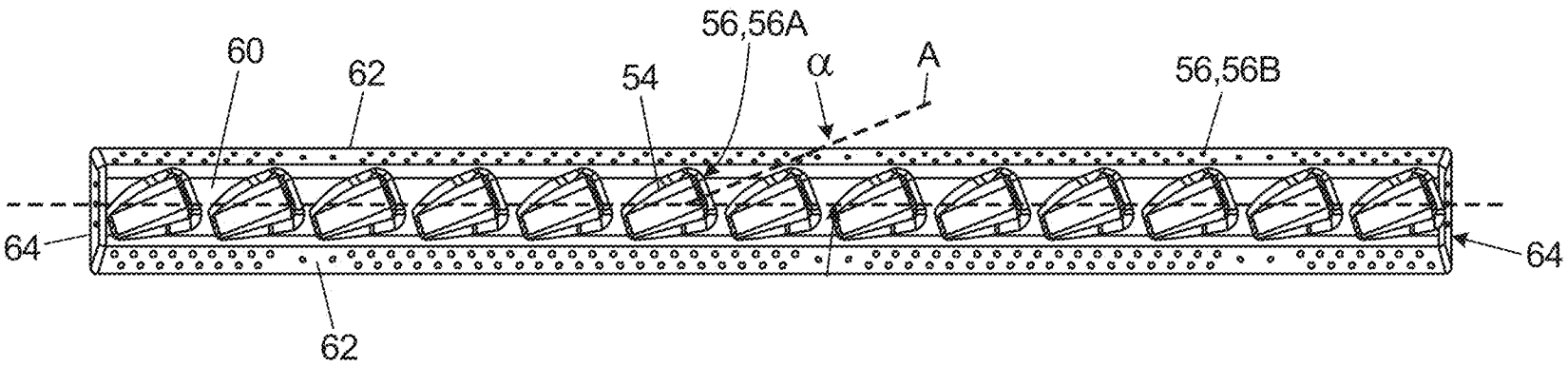
FIG. 6 is a plane view depicting the radial inner boundary of the louver segment.

FIG. 4 is an isometric view of louver segment 44. FIG. 5 is a plan view depicting a radially outer boundary of louver segment 44. FIG. 6 is a plan view depicting a radially inner boundary of louver segment 44. FIG. 7 is an axial end view of louver segment 44. Arcuate member 52, scoops 54, and outlet openings 56 are shown. FIG. 4, FIG. 5, FIG. 6, and FIG. 7 are discussed together below.

Arcuate member 52 is a curved body adapted to conform to the interior surface of combustor 28, for example, the interior surface of outer wall 40. Arcuate member 52 extends circumferentially along a portion of outer wall 40 such that louver segment 44 subtends a sector of outer wall 40 that is less than three hundred and sixty degrees. In some examples, combustor 28 can include louver segments 44 that extend less than or equal to sixty degrees, less than or equal to forty-five degrees, or less than or equal to thirty degrees. The radial outer boundary of arcuate member is open as shown in FIG. 5 while the radial inner boundary of arcuate member 52 is closed to define channel 58 as shown in FIG. 6. Channel 58 extends circumferentially along the interior surface of outer wall 40 within arcuate member 52 and communicates with openings in outer wall 40 at the radial outer boundary.

In the depicted examples, arcuate member 52 includes interior wall 60, side walls 62, and end walls 64. Interior wall 60 forms the radial inner boundary of arcuate member 52. Side walls 62 for axial boundaries of arcuate member 52 and converge radially inward from the radially outer boundary (i.e., outer wall 40 of combustor 28) towards interior wall 60. Together, interior wall 60 and side walls 62 can form a V-shaped cross-section of arcuate member 52. End walls 64 are disposed at opposite circumferential ends of arcuate member 52. Interior wall 60, side walls 62, and end walls 64 bound channel 58 of louver segment 44.

Louver segment 44 is attached by a threaded connection to combustor 28, for example outer wall 40, by two or more studs, each stud extending radially outward from arcuate member 52. Studs 66 are circumferentially spaced to conform to corresponding attachment openings of outer wall 40 and are threaded for connection with outer wall 40 such as via a threaded nut. In some examples, studs 66 extend from raised boss 68 disposed within channel 58 that partially obstructs channel 58 of louver segment 44 as shown in FIG. 5. In some examples, studs 66 can be unequally spaced along the circumferential direction such that louver segment 44 must be attached to outer wall 40 with a particular orientation and/or a particular location along outer wall 40. Louver segments 44 with unequally spaced studs 66 can have the same stud spacing configuration in some examples. In other examples, at least some of louver segments 44 with unequally spaced studs 66 have different stud spacing configurations.

Interior wall 60, side walls 62, and/or end walls 64 can include outlet openings 56 that fluidly connect channel 58 to a region exterior to louver segment 44, for example, combustion chamber 46. Each outlet opening can include discharge axis A that describes the orientation of air discharged through respective outlet openings 56. Discharge axis A extends through the geometric center of each outlet opening 56 and normal to a cross-sectional area of each outlet opening 56.

Louver segment 44 includes scoops 54 protruding from interior wall 60. A first set 56A of outlet openings 56 extends through interior wall 60 and scoops 54. Each outlet opening of the first set and associated scoop 54 are oriented to direct air from channel 58 into combustion chamber 46 along a direction that includes a nonzero axial angle component and a nonzero circumferential angle component. As depicted by FIG. 3, the axial angle component of first outlet openings 56A directs air towards head wall 42 (i.e., in an upstream direction). The circumferential component can be configured to direct air in a clockwise direction, or a counterclockwise direction as viewed in an upstream direction towards head wall 42.

The axial angle component (i.e., angle $\alpha$) of first outlet openings 56A is the acute angle between discharge axis A and a tangent to a circumferential direction of the arcuate member 52 projected into a plane normal to a radial direction as shown in FIG. 6. In some examples, the axial component angle of the first set of outlet openings 56A can be greater than zero degrees and less than or equal to sixty degrees. In other examples, the axial component angle of the first set of outlet openings 56 can be greater than zero degrees and less than or equal to forty-five degrees. In still other examples, the axial component angle of the first set of outlet openings 56A can be greater than zero degrees and less than or equal to twenty-five degrees. In still other examples, the axial component angle of the first set of outlet openings 56A can be greater than or equal to five degrees and less than or equal to twenty-five degrees.

The circumferential angle component (i.e., angle $\beta$) of first outlet openings 56A is the acute angle between discharge axis A and the tangent to the circumferential direction projected into a plane normal to the engine axis as illustrated in FIG. 7. In some examples, the circumferential component angle of the first set of outlet openings 56 can be greater than zero degrees and less than or equal to twenty-five degrees. In other examples, the circumferential component angle of the first set of outlet openings 56A can be greater than zero degrees and less than or equal to ten degrees. In still other examples, the axial component angle of the first set of outlet openings 56A can be greater than zero degrees and less than or equal to five degrees.

Louver segment 44 can include additional sets of outlet openings 56 in combination with the first set of outlet openings 56A. In some examples, a second set of outlet openings 56B fluidly connect channel 58 to combustion chamber 46 through one or both of side walls 62 to direct air along outer wall 40 in a direction away from head wall 42 (i.e., a downstream direction) and/or in a direction towards head wall 42 (i.e., an upstream direction). Likewise, other examples of louver segment 44 can include a third set of outlet openings 56C fluidly connecting channel 58 to combustion chamber 46 through one or both end walls 64. Louver segment 44 can include at least first outlet openings through interior wall 60 and scoop 54 and may additionally include one or more of second outlet openings through side walls 62 and third outlet openings through end walls 64.

In operation, air from plenum 26 passes through openings in outer wall 40 to channel 58 of one or more louver segments 44. Air within channel 58 is directed through first outlet openings 56A and, in some examples, second outlet openings, third outlet openings, or both. Air discharging through first outlet openings 56A generates a toroidal air flow biased in an axial direction towards head wall 42, which prevents or discourages flame stabilization in the vicinity of louver segment 44 or segments 44. The air discharged via scoops 54 has an axial flow component that further cools outer wall 40 in a region adjacent to louver segments 44, which is particularly beneficial for cooling outer wall 40 configured with radial step 48. Air discharged via scoops 54 additionally includes a circumferential flow component, which cools adjacent scoops 54 and interior wall 60 of louver segment 44.

DISCUSSION OF POSSIBLE EMBODIMENTS

The following are non-exclusive descriptions of possible embodiments of the present invention.

Louver Segment

A louver segment according to an example embodiment of this disclosure, among other possible things, includes an arcuate member, a plurality of scoops, and a plurality of first outlet openings. The arcuate member includes an interior wall and side walls extending partially circumferentially about a centerline axis to bound a channel that is open at a radial outer boundary of the arcuate member. The side walls converge towards the interior wall. The plurality of scoops extends from the interior wall. The plurality of first outlet openings extends through the interior wall and the scoops to place the channel in fluid communication with a region exterior to the louver segment. Each first outlet opening includes a discharge axis extending through a geometric center of a cross-sectional area of each outlet opening. Each discharge axis has a nonzero axial angle component and a nonzero circumferential angle component.

The louver segment of the preceding paragraph can optionally include, additionally and/or alternatively, any one or more of the following features, configurations and/or additional components.

A further embodiment of the foregoing louver segment can further include end walls disposed at circumferential ends of the arcuate member that bound the channel.

A further embodiment of any of the foregoing louver segments can further include integrally cast threaded studs extending radially outward from the arcuate member.

A further embodiment of any of the foregoing louver segments can further include wherein the studs extend from a raised boss within the channel.

A further embodiment of any of the foregoing louver segments can further include a plurality of second outlet openings extending through the side walls of the louver segment.

A further embodiment of any of the foregoing louver segments, wherein the axial component angle can be greater than zero degrees and less than or equal to sixty degrees.

A further embodiment of any of the foregoing louver segments, wherein the circumferential component angle can be greater than zero degrees and less than or equal to ten degrees.

A further embodiment of any of the foregoing louver segments, wherein the axial component angle can be greater than zero degrees and less than or equal to twenty-five degrees.

A further embodiment of any of the foregoing louver segments, wherein the side walls and the interior wall can form a V-shaped cross-section.

A Gas Turbine Combustor Assembly

A gas turbine combustor assembly according to an example embodiment of this disclosure, among other possible things, includes a combustor having a liner wall and a louver segment extending circumferentially around an interior surface of the liner wall. The louver segment includes an arcuate member, a plurality of scoops, and a plurality of first outlet openings. The arcuate member includes an interior wall and side walls extending partially circumferentially about a centerline axis to bound a channel that is open at a radial outer boundary of the arcuate member. The side walls converge towards the interior wall. The plurality of scoops extends from the interior wall. The plurality of first outlet openings extends through the interior wall and the scoops to place the channel in fluid communication with a region exterior to the louver segment. Each first outlet opening includes a discharge axis extending through a geometric center of a cross-sectional area of each outlet opening. Each discharge axis has a nonzero axial angle component and a nonzero circumferential angle component.

The louver segment of the preceding paragraph can optionally include, additionally and/or alternatively, any one or more of the following features, configurations and/or additional components.

A further embodiment of any of the foregoing gas turbine combustor assembly can further include end walls disposed at circumferential ends of the arcuate member that bound the channel.

A further embodiment of any of the foregoing louver segments can further include integrally cast threaded studs extending radially outward from the arcuate member.

A further embodiment of any of the foregoing gas turbine combustor assemblies can further include wherein the studs extend from a raised boss within the channel.

A further embodiment of any of the foregoing gas turbine combustor assemblies can further include a plurality of second outlet openings extending through the side walls of the louver segment.

A further embodiment of any of the foregoing gas turbine combustor assemblies, wherein the axial component angle can be greater than zero degrees and less than or equal to sixty degrees.

A further embodiment of any of the foregoing gas turbine combustor assemblies, wherein the circumferential component angle can be greater than zero degrees and less than or equal to ten degrees.

A further embodiment of any of the foregoing gas turbine combustor assemblies, wherein the axial component angle can be greater than zero degrees and less than or equal to twenty-five degrees.

A further embodiment of any of the foregoing gas turbine combustor assemblies, wherein the side walls and the interior wall can form a V-shaped cross-section.

A further embodiment of any of the foregoing gas turbine combustor assemblies, wherein the louver segment is attached to the interior surface of the liner wall.

A further embodiment of any of the foregoing gas turbine combustor assemblies wherein the louver segment is attached to the interior surface of the liner wall via a threaded connection.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A louver segment for a gas turbine combustor having a circumferentially extending liner wall, the louver segment comprising:

an arcuate member extending partially circumferentially about a centerline axis, the arcuate member comprising:

an interior wall and side walls extending circumferentially about the centerline axis to bound a channel that is open at a radial outer boundary of the arcuate member, wherein the side walls converge towards the interior wall;

a plurality of scoops extending from the interior wall; and a plurality of first outlet openings extending through the interior wall and the plurality of scoops to place the channel in fluid communication with a region exterior to the louver segment, each first outlet opening comprises:

a discharge axis extending through a geometric center of a cross-sectional area of the respective first outlet opening and extending normal to the cross-sectional area of the respective first outlet opening, each discharge axis having a nonzero axial angle component and a nonzero circumferential angle component, wherein the axial angle component is an acute angle between the discharge axis and a tangent to a circumferential direction relative to the centerline axis projected into a plane normal to a radial direction relative to the centerline axis, and wherein the circumferential angle component is an acute angle between the discharge axis and a tangent to the circumferential direction relative to the centerline axis projected into a plane normal to the centerline axis, and wherein the axial component angle is greater than zero degrees and less than or equal to sixty degrees.

2. The louver segment of claim 1, further comprising:

end walls disposed at circumferential ends of the arcuate member that bound the channel.

3. The louver segment of claim 2, further comprising:

integrally cast threaded studs extending radially outward from the arcuate member.

4. The louver segment of claim 3, wherein the studs extend from a raised boss within the channel.

5. The louver segment of claim 1, further comprising:

a plurality of second outlet openings extending through the side walls of the louver segment.

6. The louver segment of claim 1, wherein the circumferential component angle is greater than zero degrees and less than or equal to ten degrees.

7. The louver segment of claim 6, wherein the axial component angle is greater than zero degrees and less than or equal to twenty-five degrees.

8. The louver segment of claim 1, wherein the side walls and the interior wall form a V-shaped cross-section.

9. A gas turbine combustor assembly comprising:

a combustor having a liner wall and a louver segment extending circumferentially around an interior surface of the liner wall, the louver segment comprising:

an arcuate member extending partially circumferentially about a centerline axis, the arcuate member comprising:

an interior wall and side walls extending circumferentially about the centerline axis to bound a channel that is open at a radial outer boundary of the arcuate member, wherein the side walls converge towards the interior wall;

a plurality of scoops extending from the interior wall; and a plurality of first outlet openings extending through the interior wall and the plurality of scoops to place the channel in fluid communication with a region exterior to the louver segment, each first outlet opening comprises:

a discharge axis extending through a geometric center of a cross-sectional area of the respective first outlet opening and extending normal to the cross-sectional area of the respective first outlet opening, each discharge axis having a nonzero axial angle component and a nonzero circumferential angle component, wherein the axial angle component is an acute angle between the discharge axis and a tangent to a circumferential direction relative to the centerline axis projected into a plane normal to a radial direction relative to the centerline axis, and wherein the circumferential angle component is an acute angle between the discharge axis and a tangent to the circumferential direction relative to the centerline axis projected into a plane normal to the centerline axis, and wherein the axial component angle is greater than zero degrees and less than or equal to sixty degrees.

10. The gas turbine combustor assembly of claim 9, wherein the louver segment further comprises:

end walls disposed at circumferential ends of the arcuate member that bound the channel.

11. The gas turbine combustor assembly of claim 10, wherein the louver segment further comprises:

integrally cast threaded studs extending radially outward from the arcuate member.

12. The gas turbine combustor assembly of claim 11, wherein the studs extend from a raised boss within the channel.

13. The gas turbine combustor assembly of claim 9, wherein the louver segment further comprises:

a plurality of second outlet openings extending through the side walls of the louver segment.

14. The gas turbine combustor assembly of claim 9, wherein the circumferential component angle is greater than zero degrees and less than or equal to ten degrees.

15. The gas turbine combustor assembly of claim 14, wherein the axial component angle is greater than zero degrees and less than or equal to twenty-five degrees.

16. The gas turbine combustor assembly of claim 9, wherein the side walls and the interior wall form a V-shaped cross-section.

17. The gas turbine combustor assembly of claim 9, wherein the liner wall of the combustor includes:

an inner wall spaced radially inward from an outer wall to form an annular combustion chamber; and a head wall extending from the inner wall to the outer wall to enclose an upstream end of the combustor, and wherein the discharge axis is biased towards the head wall.

* * * * *